US012415660B2

(12) United States Patent
Baruch et al.

(10) Patent No.: US 12,415,660 B2
(45) Date of Patent: Sep. 16, 2025

(54) CHEST WITH QUICK ACCESS COVER

(71) Applicant: The Stanley Works Israel Ltd., Rosh Ha'Ayin (IL)

(72) Inventors: Danny Baruch, Lapid (IL); Arie Krasavets, Ramat-Gan (IL); Noam Twig, Petach Tikqva (IL); Dan Haber, Kibbutz Gevim (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 92 days.

(21) Appl. No.: 18/385,558

(22) Filed: Oct. 31, 2023

(65) Prior Publication Data

US 2024/0150087 A1 May 9, 2024

Related U.S. Application Data

(60) Provisional application No. 63/382,172, filed on Nov. 3, 2022.

(51) Int. Cl.
*B65D 43/16* (2006.01)
*B65D 21/02* (2006.01)
(Continued)

(52) U.S. Cl.
CPC ..... *B65D 43/163* (2013.01); *B65D 21/023* (2013.01); *B65D 43/22* (2013.01);
(Continued)

(58) Field of Classification Search
CPC .... B65D 43/163; B65D 21/023; B65D 43/22; B65D 51/18; B65D 2251/0021;
(Continued)

(56) References Cited

U.S. PATENT DOCUMENTS 466,194 A 12/1891 Snaman, Jr.
4,775,199 A 10/1988 Lanius et al.
(Continued)

FOREIGN PATENT DOCUMENTS

CN 108500931 A 9/2018
DE 102013202869 A1 * 9/2013 ..... B25H 3/022
(Continued)

OTHER PUBLICATIONS

English translation of DE 102013202869 (Year: 2013).*

*Primary Examiner* — Don M Anderson
*Assistant Examiner* — Eric C Baldrighi
(74) *Attorney, Agent, or Firm* — Mintz, Levin, Cohn, Ferris, Glovsky and Popeo, P.C.

(57) ABSTRACT

A stackable storage system is disclosed. The system includes a base storage container disposed on a wheeled cart, and one or more additional storage containers removably secured on top of the base container. A main lid is disposed on the storage container and is pivotable between a position in which it covers at least a portion of the interior storage volume and a position in which it does not cover the interior storage volume. The main lid has a main lid opening formed therethrough. A secondary lid is pivotable between a position in which it covers the opening and a second position in which it does not cover the opening to allow access to the interior storage volume via the opening while the main lid covers the interior storage volume.

19 Claims, 22 Drawing Sheets

(51) Int. Cl.
*B65D 43/22* (2006.01)
*B65D 51/18* (2006.01)

(52) U.S. Cl.
CPC ..... *B65D 51/18* (2013.01); *B65D 2251/0021* (2013.01); *B65D 2251/0084* (2013.01)

(58) Field of Classification Search
CPC ..... B65D 2251/0084; B65D 21/0217; B65D 2543/00231; B65D 2533/0024; B25H 3/02
USPC ..... 206/508
See application file for complete search history.

(56) References Cited

U.S. PATENT DOCUMENTS

| | | | | |
|---|---|---|---|---|
| 5,337,911 | A * | 8/1994 | Holub | A45C 11/20 220/254.3 |
| D390,358 | S | 2/1998 | Calmeise | |
| 5,915,553 | A | 6/1999 | Brown et al. | |
| 6,170,723 | B1 | 1/2001 | Howell | |
| 7,278,537 | B2 * | 10/2007 | Lown | A47B 3/0912 206/45.24 |
| 7,334,680 | B2 | 2/2008 | Cunningham et al. | |
| 7,387,350 | B2 | 6/2008 | Killinger et al. | |
| 7,823,991 | B2 | 11/2010 | Purdy | |
| D649,350 | S | 11/2011 | Shitrit | |
| 8,267,247 | B1 | 9/2012 | Horiyama | |
| 8,505,729 | B2 * | 8/2013 | Sosnovsky | B65D 45/22 220/756 |
| 8,777,045 | B2 | 7/2014 | Mitchell et al. | |
| 9,422,099 | B2 | 8/2016 | Mitchell et al. | |
| 9,868,583 | B2 | 1/2018 | Mitchell et al. | |
| 10,045,596 | B2 | 8/2018 | Lundy et al. | |
| 10,286,542 | B2 | 5/2019 | Wolle et al. | |
| D899,087 | S | 10/2020 | Kuhls | |
| 11,059,631 | B1 * | 7/2021 | Brunner | B65D 21/0217 |
| 11,230,410 | B2 * | 1/2022 | Brunner | B25H 3/02 |
| 2004/0222174 | A1 | 11/2004 | Killinger et al. | |
| 2004/0232022 | A1 | 11/2004 | Killinger et al. | |
| 2005/0000838 | A1 | 1/2005 | Killinger et al. | |
| 2005/0247596 | A1 | 11/2005 | Manley et al. | |
| 2007/0131572 | A1 | 6/2007 | Killinger et al. | |
| 2007/0235452 | A1 * | 10/2007 | Killinger | B65D 43/161 220/326 |
| 2008/0245095 | A1 | 10/2008 | Schlipman et al. | |
| 2008/0251526 | A1 * | 10/2008 | Fick | B65D 43/161 206/508 |
| 2013/0334229 | A1 * | 12/2013 | McCanless | B65D 41/02 220/324 |
| 2017/0121056 | A1 * | 5/2017 | Wang | B65D 21/0228 |
| 2018/0149400 | A1 | 5/2018 | Valencia | |
| 2019/0002004 | A1 * | 1/2019 | Brunner | B25H 3/023 |
| 2019/0233196 | A1 | 8/2019 | Skinner et al. | |
| 2020/0180140 | A1 * | 6/2020 | Brocket | B25H 3/02 |
| 2020/0298392 | A1 * | 9/2020 | Baruch | B25H 3/02 |
| 2020/0384633 | A1 | 12/2020 | Samsel et al. | |
| 2022/0396985 | A1 * | 12/2022 | Li | E05C 19/063 |

FOREIGN PATENT DOCUMENTS

| | | | |
|---|---|---|---|
| DE | 202017103012 | U1 | 6/2017 |
| DE | 202019104418 | U1 | 8/2019 |
| EP | 2522468 | B1 | 12/2013 |
| EP | 2516115 | B1 | 9/2016 |
| EP | 2338650 | B1 | 10/2016 |
| WO | 2013074579 | A1 | 5/2013 |
| WO | 2017149539 | A1 | 9/2017 |
| WO | 2020055726 | A1 | 3/2020 |
| WO | 2021108890 | A1 | 6/2021 |

* cited by examiner

CHEST WITH QUICK ACCESS COVER

CROSS-REFERENCE TO RELATED APPLICATION

This application claims priority to U.S. Provisional Application No. 63/382,172, filed on Nov. 3, 2022, all titled "CHEST WITH QUICK ACCESS COVER". The entire contents are hereby incorporated herein by reference in its entirety.

FIELD OF THE INVENTION

The present invention relates to a chest which may form part of a stackable storage container system which include a plurality of storage containers which may be secured to each other for joint movement by a wheeled cart and which allows for access to the interior of the chest while storage containers are stacked on a portion of the cover of the chest.

BACKGROUND

Stackable storage containers are known, for example, the rolling container assembly shown in U.S. Pat. Nos. 8,132,819 and 9,132,543, which are hereby incorporated by reference. The assembly disclosed therein includes a base storage container which is disposable on a cart which is provided with wheels and an integral handle system. At least one further storage container may be removably attached on top of the base container, allowing for multiple containers to be jointly transported. The mechanism for attaching the containers to each other may include a stacking latch mechanism, for example, as shown in U.S. Patent Application Publication No. 2020/0025229 which is hereby incorporated by reference. The mechanism includes a spring loaded pivotable latch having a hook disposed on the lid of the container and a step formed on the lower housing of the container. The latch includes a hook which is selectively disposed over the step and thereby secure the containers together. U.S. Pat. No. 8,505,729 discloses a stackable container system in which each container includes a latch member and a ledge formed on the outer surface. The latch of a lower container is foldable over the ledge of an upper container to secure the upper and lower containers together.

SUMMARY OF THE INVENTION

In a first embodiment the invention is direct to a chest having a storage body defining an interior storage volume and a main lid pivotable between a first main lid position in which the main lid covers the interior storage volume and a second main lid position in which the main lid does not cover the interior storage volume. The main lid has a main lid opening formed therethrough and a main lid ledge. A secondary lid is pivotable between a first secondary lid position in which the secondary lid covers the main lid opening and a second secondary lid position in which the secondary lid does not cover the main lid opening to allow access to the interior storage volume while the main lid is in the first main lid position. A secondary lid latch is secured to the secondary lid and is movable between a first secondary lid latch position in which the secondary lid latch secures the secondary lid to the main lid and a second secondary lid latch position in which the secondary lid latch does not secure said the secondary lid to the main lid. A container latch is secured to the secondary lid and is movable between a first container latch position in which the secondary latch is precluded from moving between the first secondary lid latch position and the second secondary latch position and a second container latch position in which the secondary latch is not precluded from moving between the first secondary lid latch position and the second secondary latch position.

In a further embodiment, the invention is directed to a chest having a storage body defining an interior storage volume and a main lid having a main lid opening formed therethrough. A secondary lid is disposed on the main lid and is movable between a first secondary lid position where it covers the main lid opening and a second secondary lid position where it does not cover the main lid opening. A first latch is disposed on the secondary lid and releasably secures an external container to the secondary lid. A secondary latch is movable between a first secondary latch position in which it secures the secondary lid in the first secondary lid position and second secondary latch position in which it does not secure the secondary lid in the first secondary lid position.

In a still further embodiment, the invention is directed to a stackable system including a chest and a container. The container includes a step. The chest includes a storage body defining an interior storage volume. A main lid is pivotable between a first main lid position in which the main lid covers the interior storage volume and a second main lid position in which the main lid does not cover the interior storage volume. The main lid has a main lid opening formed therethrough and a main lid ledge. A secondary lid is pivotable between a first secondary lid position in which the secondary lid covers the main lid opening and a second secondary lid position in which the secondary lid does not cover the main lid opening to allow access to the interior storage volume while the main lid is in the first main lid position. A secondary lid latch is secured to the secondary lid. The secondary lid latch is movable between a first secondary lid latch position in which the secondary lid latch secures the secondary lid to the main lid and a second secondary lid latch position in which the secondary lid latch does not secure the secondary lid to the main lid. A container latch is secured to the secondary lid. The container latch includes a latch tooth and is movable between a first container latch position in which the latch tooth may overlie the step to secure the container to the secondary lid when the container is disposed on the secondary lid and a second position in which the latch tooth does not overlie the step to allow the container to be removed from the secondary lid. When the container latch is in the first container latch position with the container disposed on the secondary lid, the secondary lid latch is precluded from moving between the first secondary lid latch position and the second secondary lid latch position.

These and other objects, features, and characteristics of the present invention, as well as the methods of operation and functions of the related elements of structure and the combination of parts will become more apparent upon consideration of the following description and the appended claims with reference to the accompanying drawings, all of which form a part of this specification, wherein like reference numerals designate corresponding parts in the various figures. It is to be expressly understood, that the drawings are for the purpose of illustration and description only, and are not intended as a definition of the limits of the invention. In addition, it should be appreciated that structural features shown or described in any one embodiment herein can be used in other embodiments as well. As used in the specification and in the claims, the singular form of "a", "an", and "the" include plural references unless the context clearly dictates otherwise.

DETAILED DESCRIPTION OF EXEMPLARY EMBODIMENTS

Figure 1:
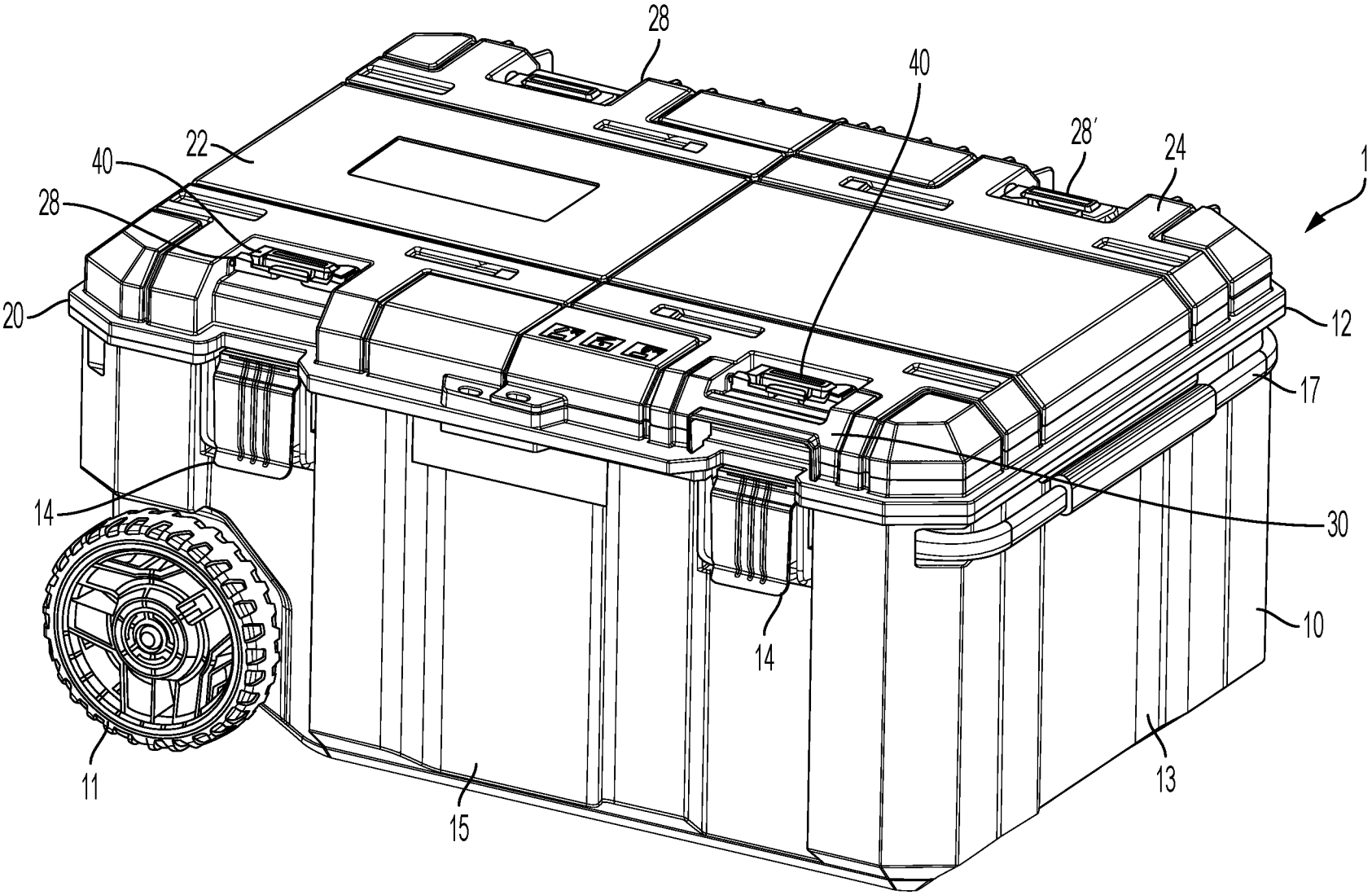
FIG. 1 is a perspective view of a chest according to the invention.
Figure 2:
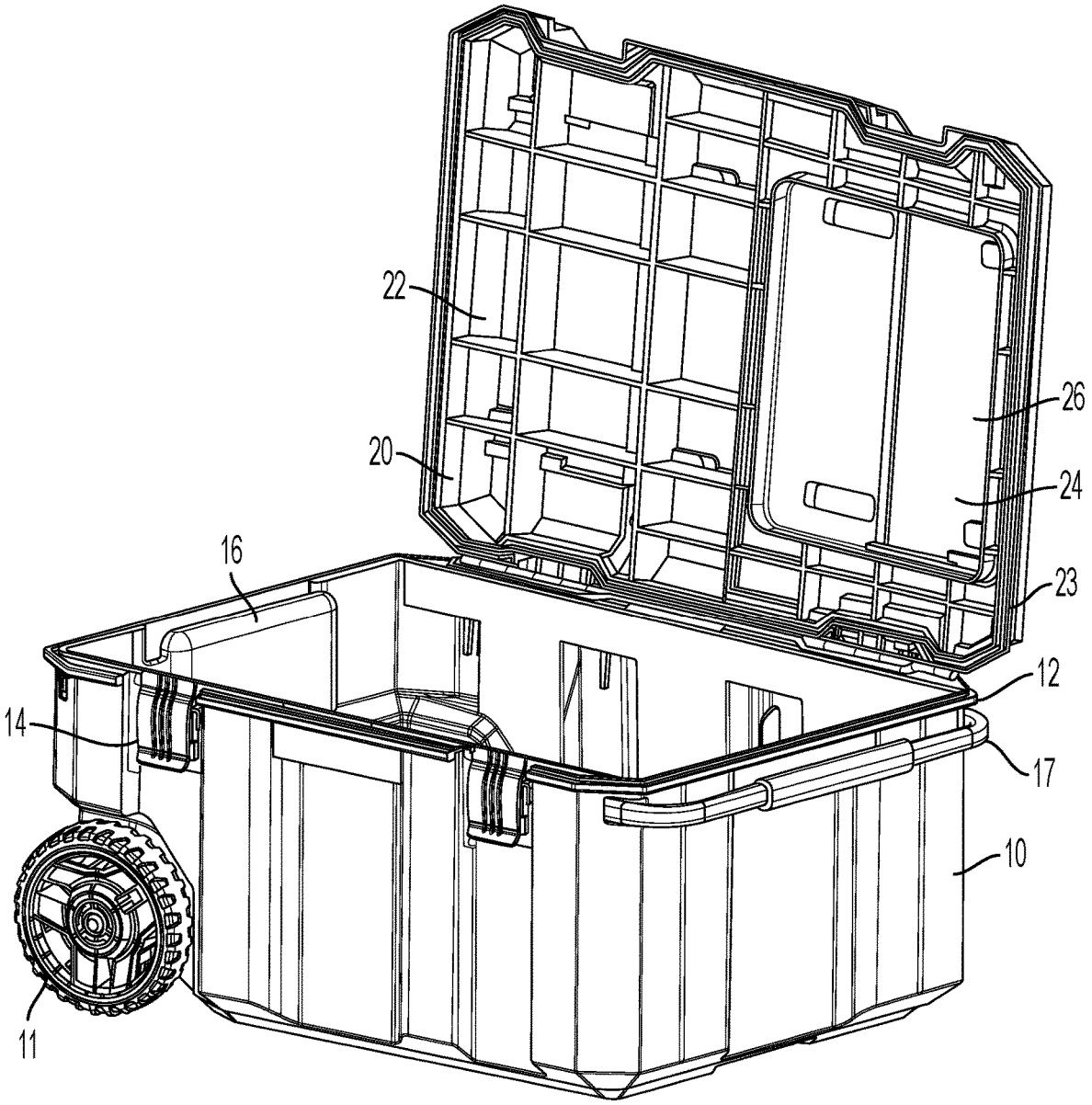
FIG. 2 is a perspective view of the chest shown in FIG. 1 with the main lid thereof in the open position.
Figure 3:
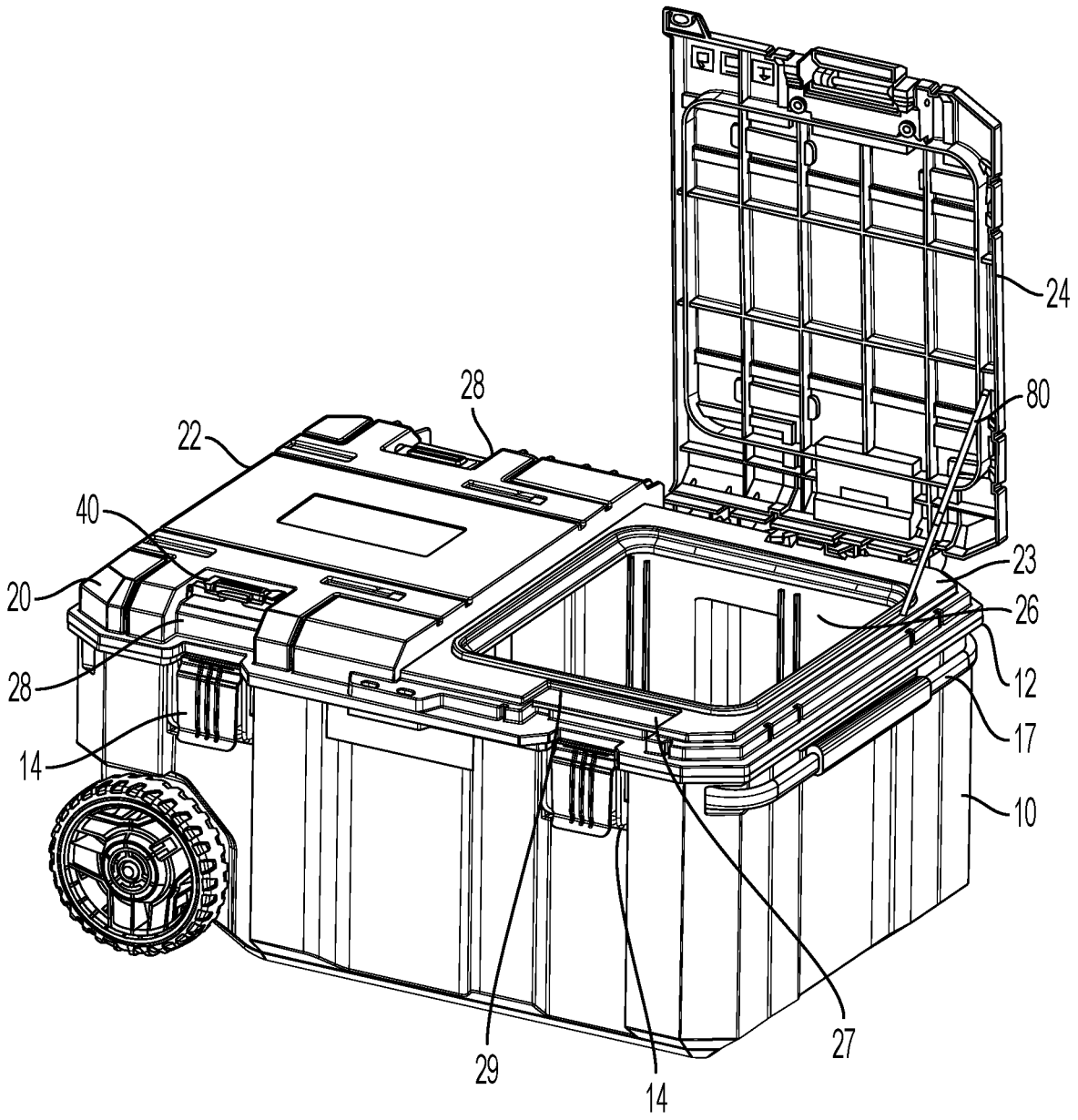
FIG. 3 is a perspective of the chest shown in FIG. 1 with the main lid in the closed position and a secondary lid in the open position.

With reference to FIGS. 1-3, a chest with a quick access cover is disclosed. Chest 1 includes storage body 10 having two opposite end walls 13 and two opposite side walls 15. For sake of description end walls 13 may be deemed left and right end walls and side walls 15 may be deemed front and rear end walls, in relation to how they are situated in FIG. 1. Other elements of the invention may also be deemed as having left, right, front or rear sides consistent with the description of end walls 13 and side walls 15. Conventional telescoping extendable handle 17 is disposed at an upper edge of right end wall 13 and conventional wheels 11 are disposed at the corners created by the left end wall 13 and both side walls 15 to allow chest 1 to be wheeled. Storage body 10 defines interior storage volume 16 and has ledge 12 formed at the upper periphery of end walls 13 and side walls 15. Conventional buckle latches 14 are disposed on front side wall 15.

Figure 1A:
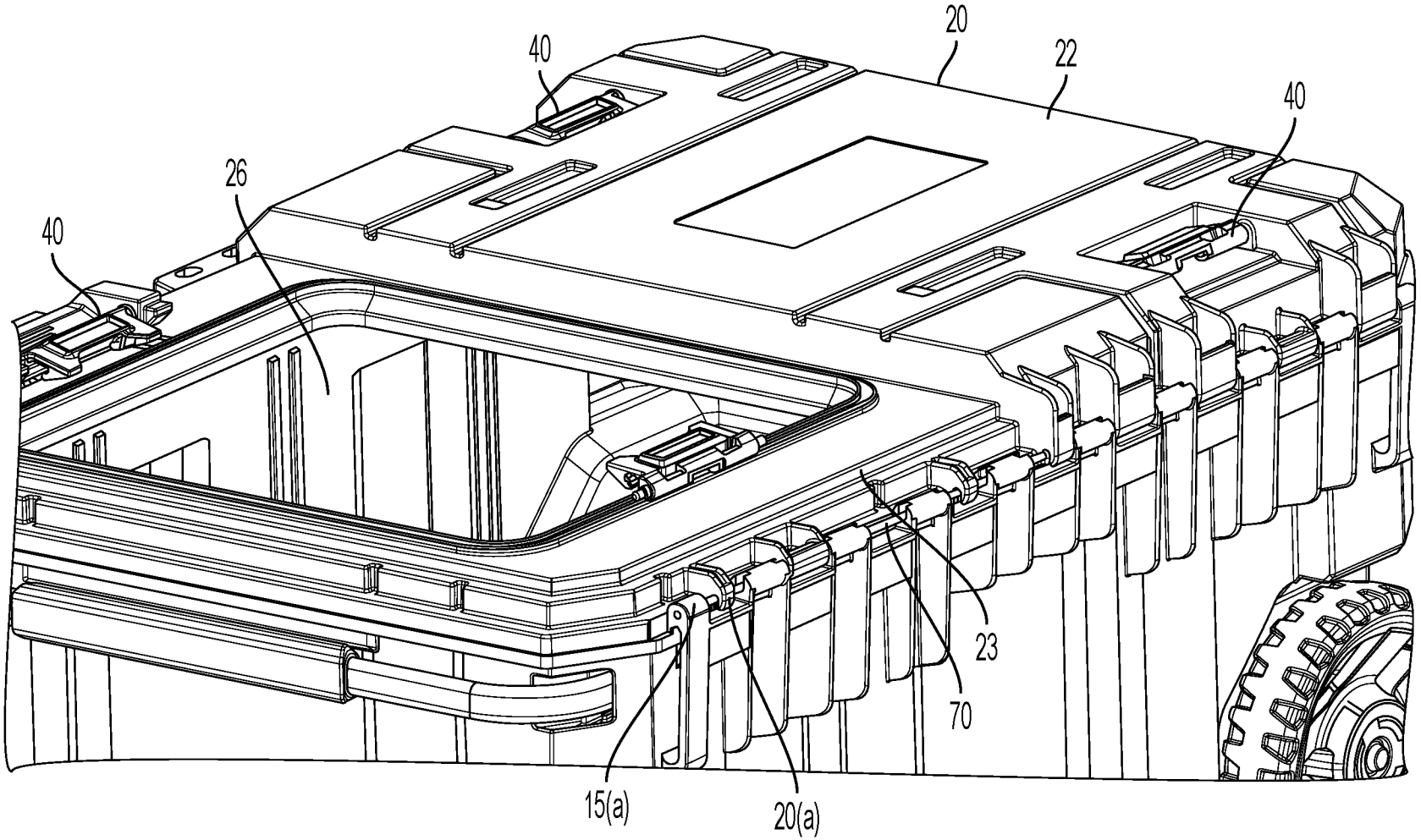
FIG. 1A is a close-up opposite side perspective view of the chest shown in FIG. 1 with the secondary lid removed.

With reference to FIG. 1A, storage body 10 includes main lid 20 having tabs 20(*a*) which further have holes formed therethrough at the rear thereof. Rear side wall 15 has tabs 15(*a*) also having holes formed therethrough. Tabs 15(*a*) and 20(*a*) are interlaced. Pivot rod 70 extends through the holes in tabs 15(*a*) and 20(*a*) to pivotably secure main lid 20 to rear side wall 15 to allow main lid 20 to pivot between a closed position in which it fully covers interior storage volume 16 and an open position in which it does not cover interior storage volume 16 to allow user access thereto to remove or replace tools or other items.

Figure 4:
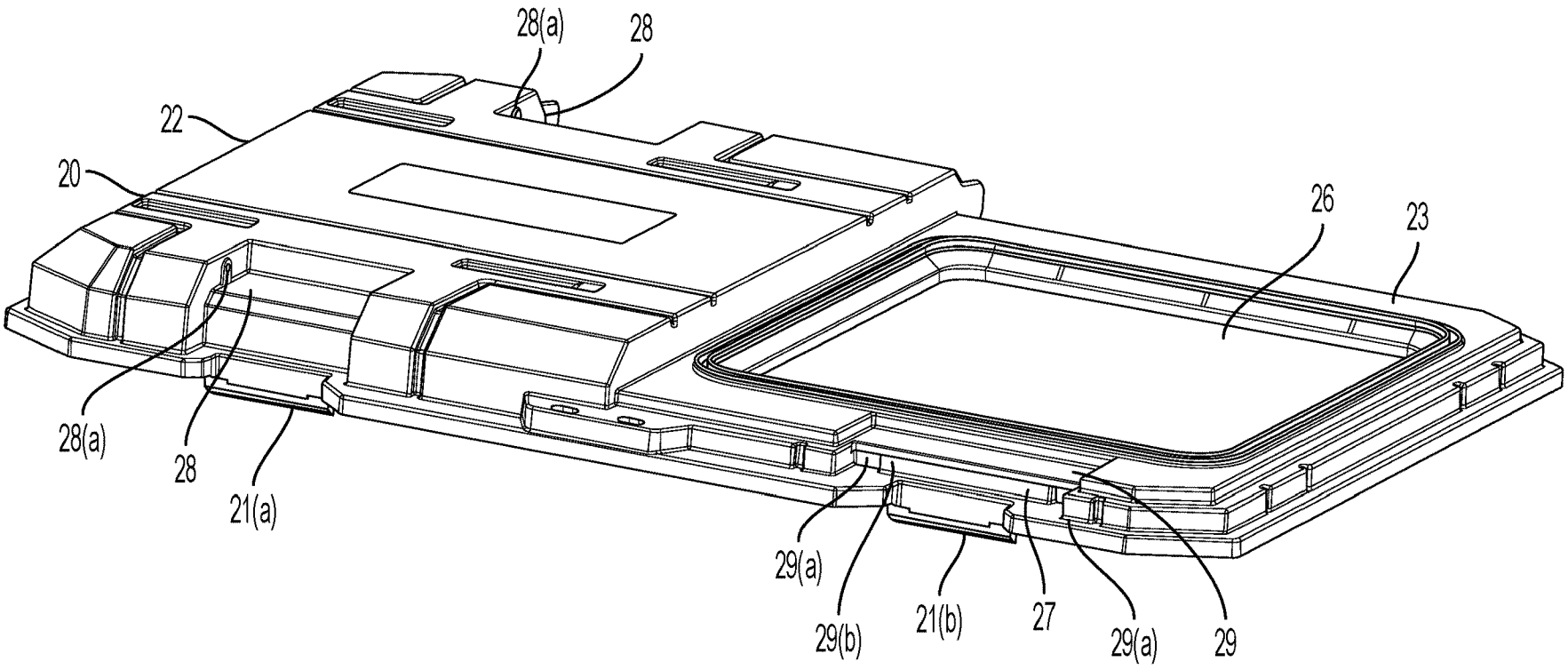
FIG. 4 is a perspective view of the main lid shown in FIG. 1.

With further reference to FIGS. 3-4, main lid 20 includes full thickness portion 22 generally forming the left side thereof and partial thickness portion 23 generally forming the right side thereof. Full thickness portion 22 incudes front and rear full depth cutouts 28 formed therein. Front cutout 28 is disposed above left buckle latch 14 secured on storage body 10 and includes left main lid ledge 21(*a*) extending downwardly therefrom and left and right openings 28(*a*) formed on opposite interior side walls of cutout 28 at upper locations. (Only one opening 28(*a*) is shown in the Figures.) Container latch 40 is pivotably disposed in front cutout 28 via pivot pins which extend through latches 40 and into openings 28(*a*). Rear cutout 28 also includes left and right openings 28(*a*) into which a further container latch 40 is pivotably disposed, as does rear cutout 28' formed in secondary lid 24.

Figure 11:
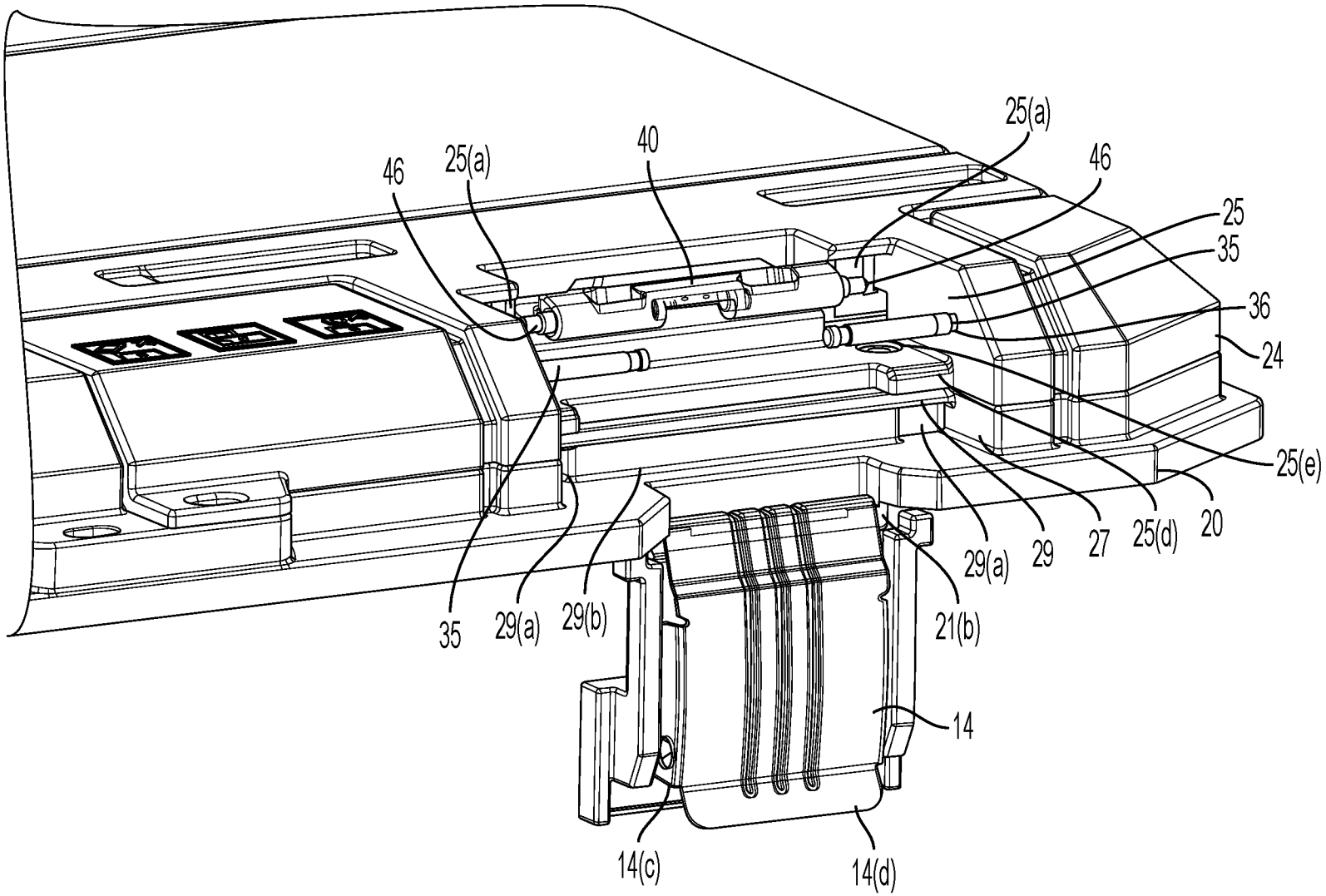
FIG. 11 is a close-up perspective view of a portion of the secondary lid shown in FIG. 5 with the secondary lid latch not shown.

With further reference to FIG. 11, main lid 20 includes opening 26 extending through partial thickness portion 23. Partial thickness portion 23 further includes partial depth cutout 27 formed in the front thereof. Main lid 20 includes secondary lid locking ledge 29 extending across partial depth cutout 27 and defining open region 29(*b*) underneath. At the left and right lateral ends, open region 29(*b*) extends further into partial thickness portion 23 to create secondary lid locking ledge openings 29(*a*). Partial depth cutout 27 also includes right main lid ledge 21(*b*) extending downwardly therefrom and laterally thereacross.

Figure 5:
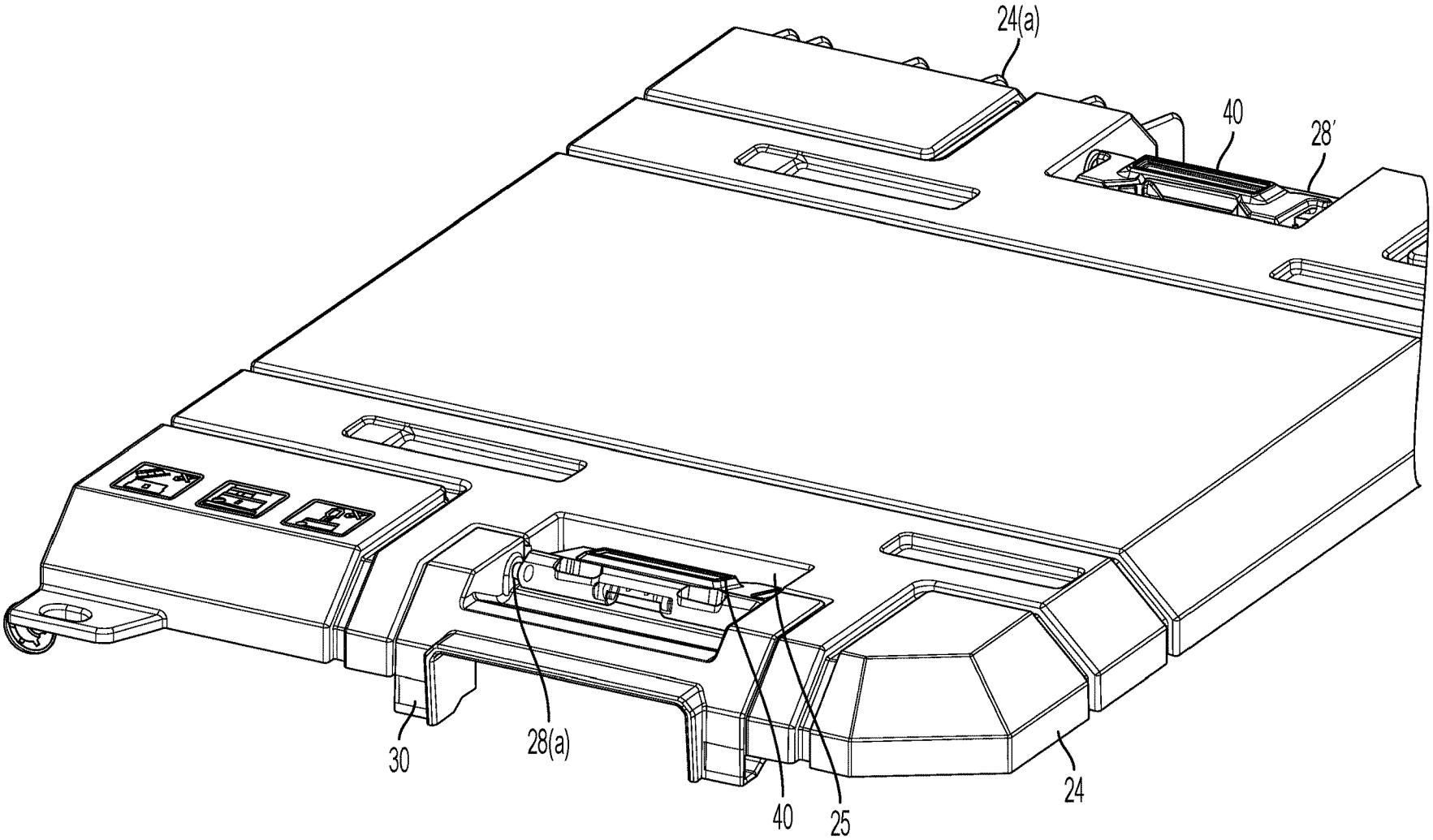
FIG. 5 is a close-up perspective view of a secondary lid shown in FIG. 1.
Figure 5A:
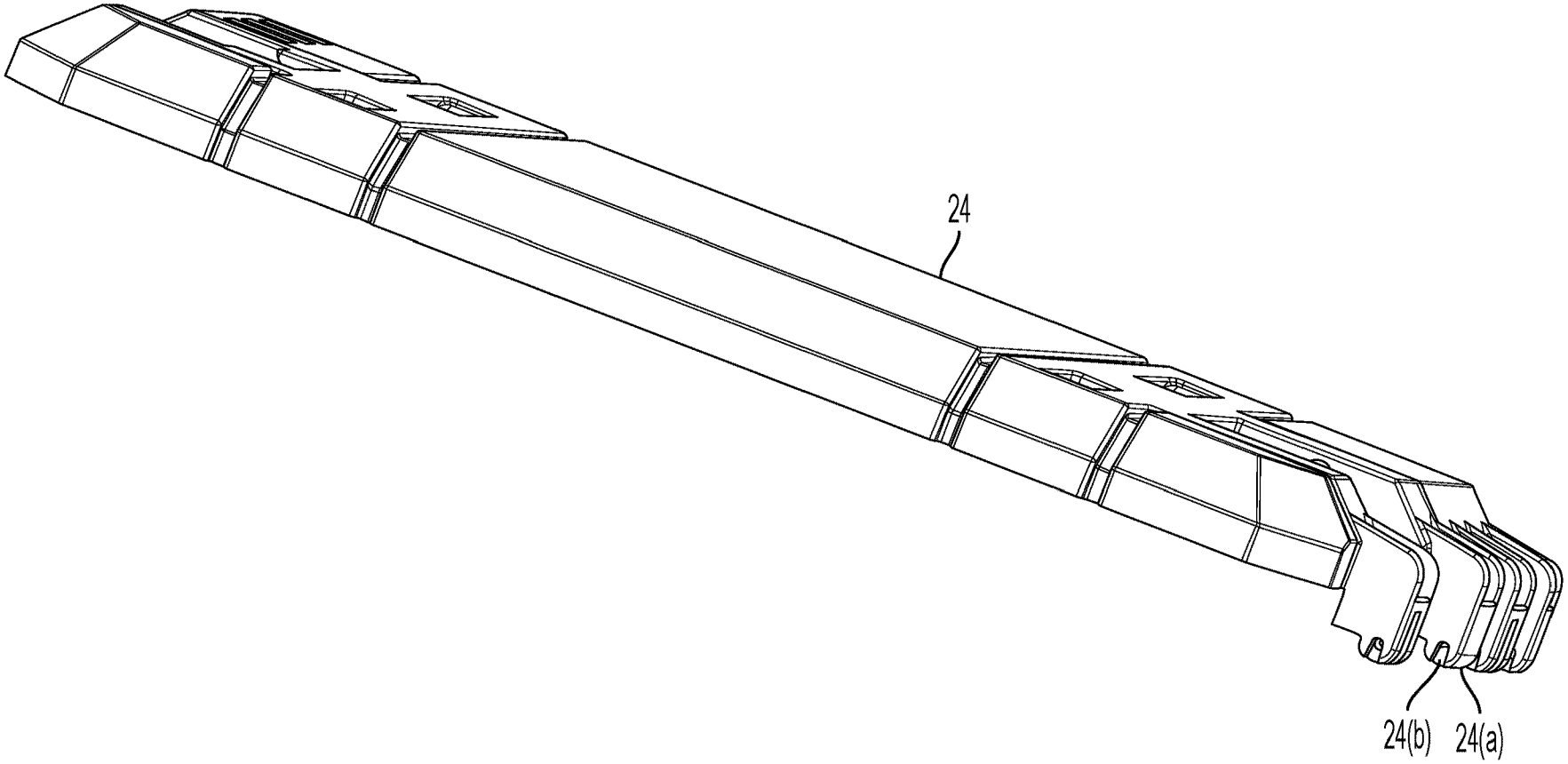
FIG. 5A is an opposite side perspective view of the secondary lid shown in FIG. 5.

With further reference to FIGS. 5 and 5A, secondary lid 24 includes rear tabs 24(*a*) having holes through which pivot rod 70 passes to allow secondary lid 24 to pivot relative to both main lid 20 and storage body 10, about the same axis as main lid 20 pivots relative to storage body 10. Secondary lid 24 is pivotable relative to main lid 20 between a position in which it covers opening 26 in main lid 20 as shown in FIG. 1 and a position in which it uncovers opening 26 as shown in FIG. 3. In the uncovered position of secondary lid 24, a user may access interior storage volume 16 even while full thickness portion 22 of main lid 20 remains in the horizontal position covering a portion of interior storage volume 16. Secondary lid arm 80 extend between the underside of secondary lid 24 and an upper surface of main lid 20 to allow secondary lid 24 to be secured in the fully open position. When secondary lid 24 is in the closed position, the upper surface of secondary lid 24 is co-planar to the upper surface of full thickness portion 22 of main lid 20. When secondary lid 24 is pivoted to the lower closed position, a lower end of secondary lid arm 80 slides in a channel formed along the interior of the upper right side edge 13 of storage body 10, with secondary lid arm 80 disposed through an opening formed in main lid 20. A suitable stopper may be disposed on the lower end of secondary lid arm 80 to allow for the sliding.

With further reference to FIGS. 1, 5 and 11, secondary lid 24 includes secondary lid full depth cutout 28' formed on the rear edge thereof and having substantially the same structure as main lid full depth cutouts 28. A further container latch 40 is pivotably disposed in secondary lid full depth cutout 28' in the same manner as container latches 40 are disposed in full depth cutout 28. Secondary lid 24 includes partial depth cutout 25 in the front edge thereof and located above partial depth cutout 27 of main lid 20 such that cutout 25 and cutout 27 form a single contiguous cutout located above right side buckle latch 14. With further reference to FIG. 11, cutout 25 includes lateral side walls into which holes 36 are formed (only the right side hole is shown in the figure.) Pivot pins 35 are secured in and extend through holes 36. Inwardly extending openings 25(*a*) are formed in cutout 25 on the upper lateral sides thereof. Cutout 25 also includes surface 25(*d*) extending thereacross and having lateral circular indents 25(*e*) (one shown) formed therein.

Figure 6:
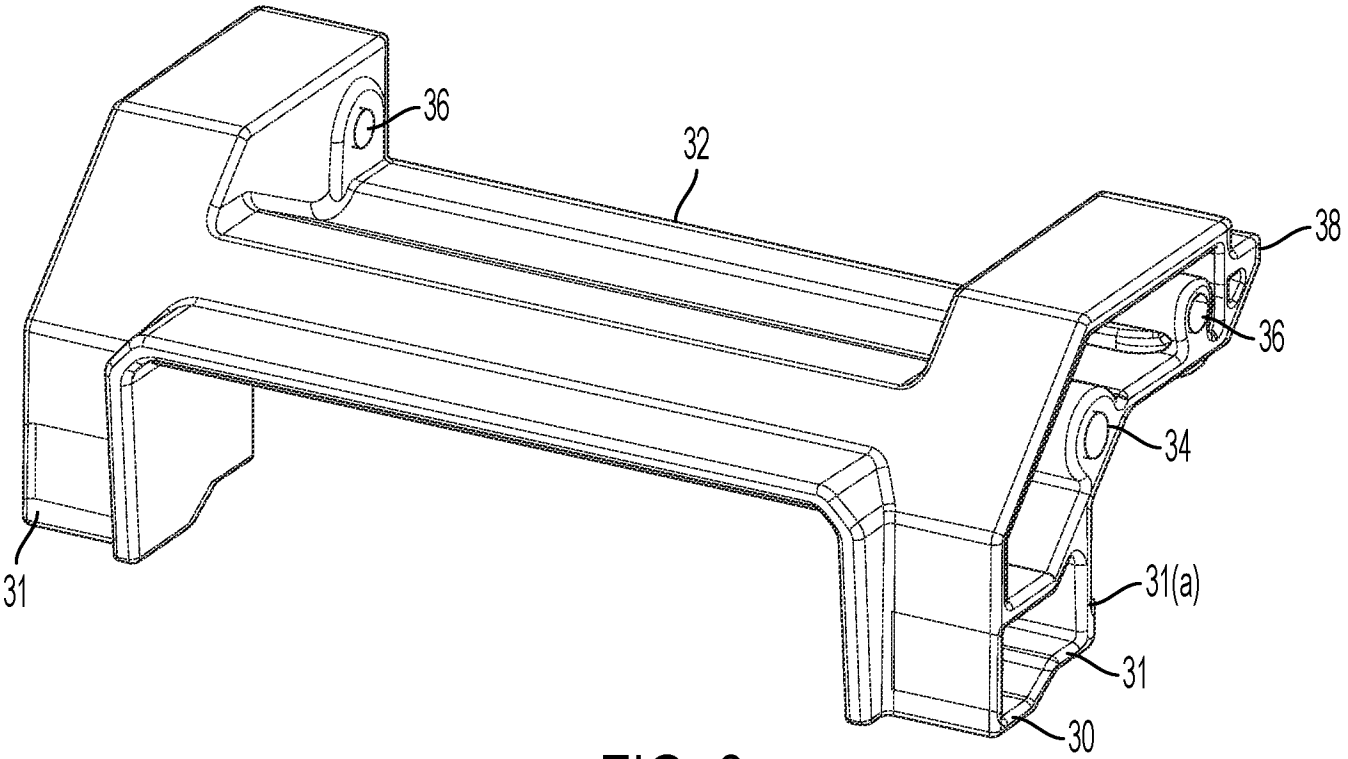
FIG. 6 is a perspective view of a secondary lid latch forming part of the invention.
Figure 7:
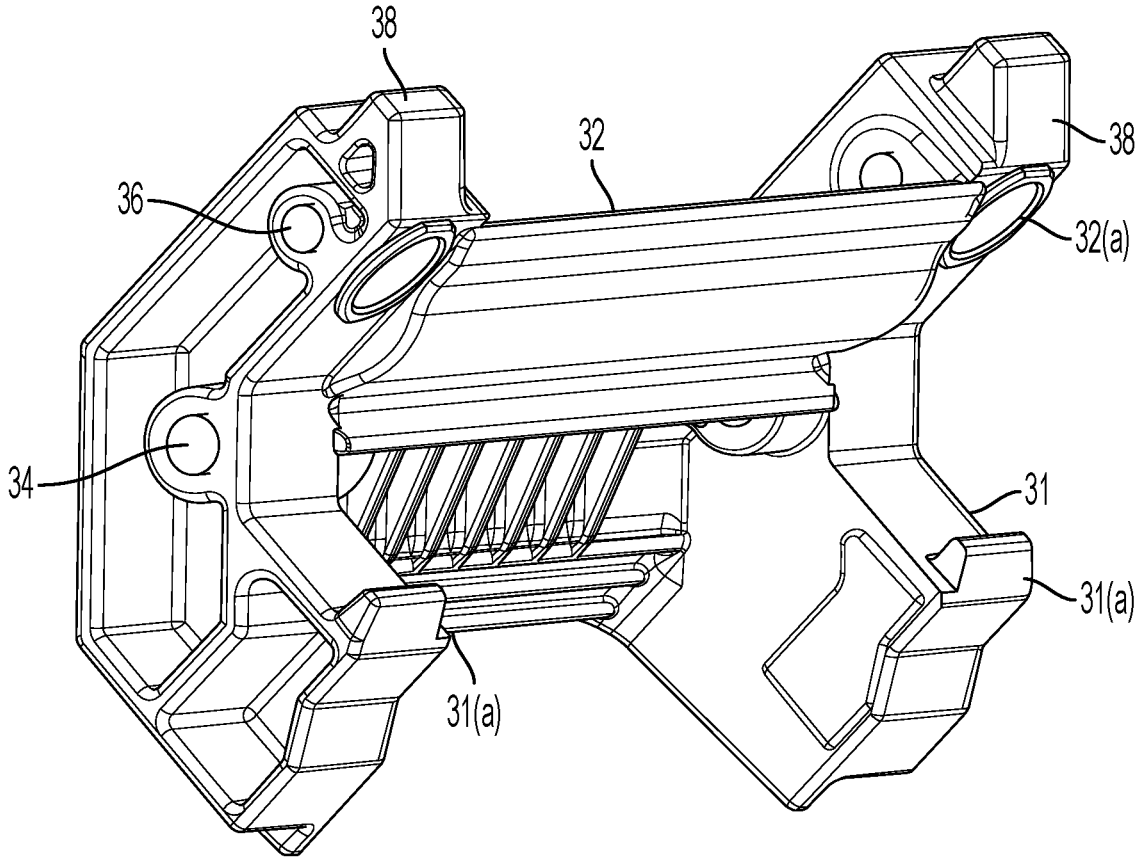
FIG. 7 is an opposite side perspective view of the secondary lid latch shown in FIG. 6.
Figure 8:
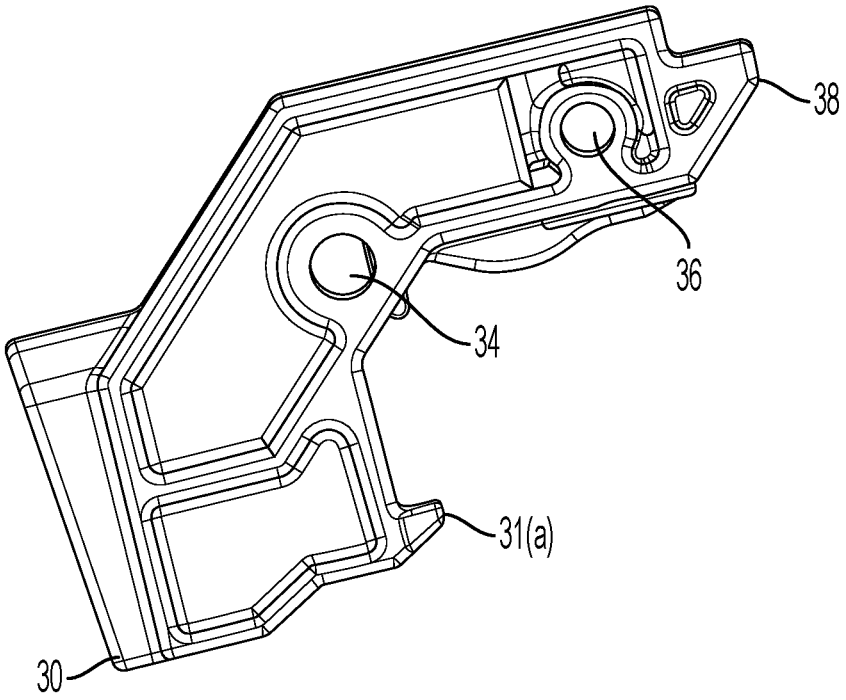
FIG. 8 is a side view of the secondary lid latch shown in FIGS. 6-7.

With reference to FIGS. 6-8, secondary lid latch 30 is shown and includes longitudinally extending main body 32 having side portions or arms 31 formed on each lateral end. Side portions 31 include secondary lid latch lower teeth 31(*a*) projecting inwardly (relative to cutout 27 in main lid 20) from a lower inward end and secondary lid latch upper teeth 38 projecting inwardly (relative to secondary lid 24 cutout 25) from an upper inward end. Holes 34 are formed on and through both side portions 31 at a middle location, and holes 36 are formed on and through both side portions 31 at an upper location.

Secondary lid latch 30 is pivotably secured in partial depth cutout 25 of secondary lid 24 of via pivot pins 35 which are disposed in holes 34, with lower lid latch teeth 31(*a*) extending below secondary lid 24 and into cutout 27 of main lid 20 at a location below secondary lid locking ledge 29. In particular, secondary lid lower latch teeth 31(*a*) are disposed in open region 29(*b*) adjacent secondary lid locking ledge openings 29(*a*). Secondary lid latch upper teeth 38 are disposed in cutout 25 of secondary lid 24 adjacent openings 25(*a*). When secondary lid latch 30 is in a first position disposed about pins 35 such that the upper end thereof is disposed in an outer position relative to secondary lid 24, secondary lid lower latch teeth 31(*a*) are disposed inwardly into openings 29(*a*), below secondary lid locking ledge 29. When secondary lid latch 30 is in a second position disposed about pins 35 such that the upper end thereof is positioned inwardly relative to secondary lid 24, secondary lid latch upper teeth 38 are disposed into openings 25(*a*) while secondary lid latch lower teeth 31(*a*) are positioned outwardly of secondary lid locking ledge 29. Therefore, when secondary lid latch 30 is in the first position as shown in FIG. 1, the positioning of lower latch teeth 31(*a*) below locking ledge 29 locks secondary lid 24 to main lid 20 in the closed position to cover opening 26.

In order to release secondary lid 24 from main lid 20, main body 32 is grasped and pushed upwardly to move secondary lid latch into the second position allowing secondary lid lower latch teeth 31(*a*) to move outwardly clear from secondary lid locking ledge 29 to unlock secondary lid 24 from main lid 20, and allow secondary lid 24 to be pivoted to the upper position to provide access to interior storage volume 16. With reference to FIG. 15C, coil springs 53 (only one shown) are disposed between circular openings 32(*a*) formed in secondary lid latch main body 32 and indents 25(*e*) formed in surface 25(*d*). Secondary lid latch 30 may be pivoted about pins 35 between the first and second positions with coil springs 53 biasing secondary lid latch 30 into the first position to lock secondary lid 24 to main lid 20.

Figure 9:
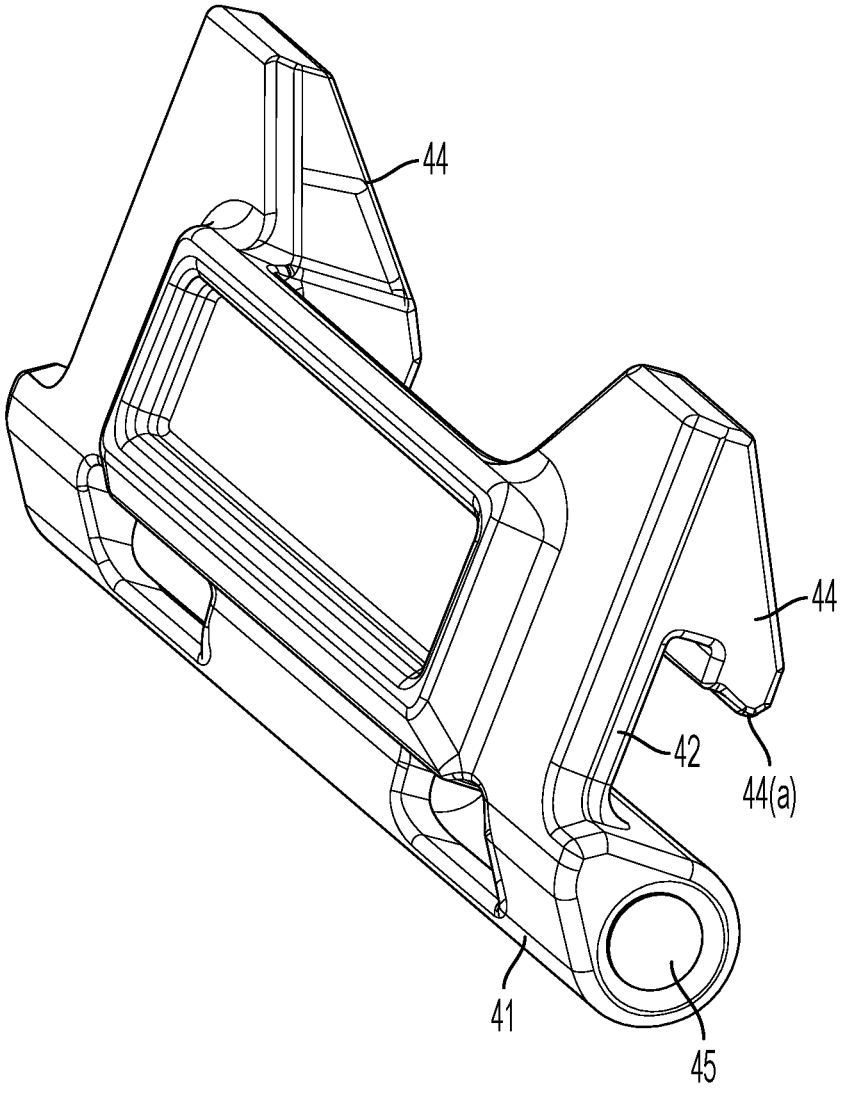
FIG. 9 is a perspective view of a container latch forming part of the invention
Figure 10:
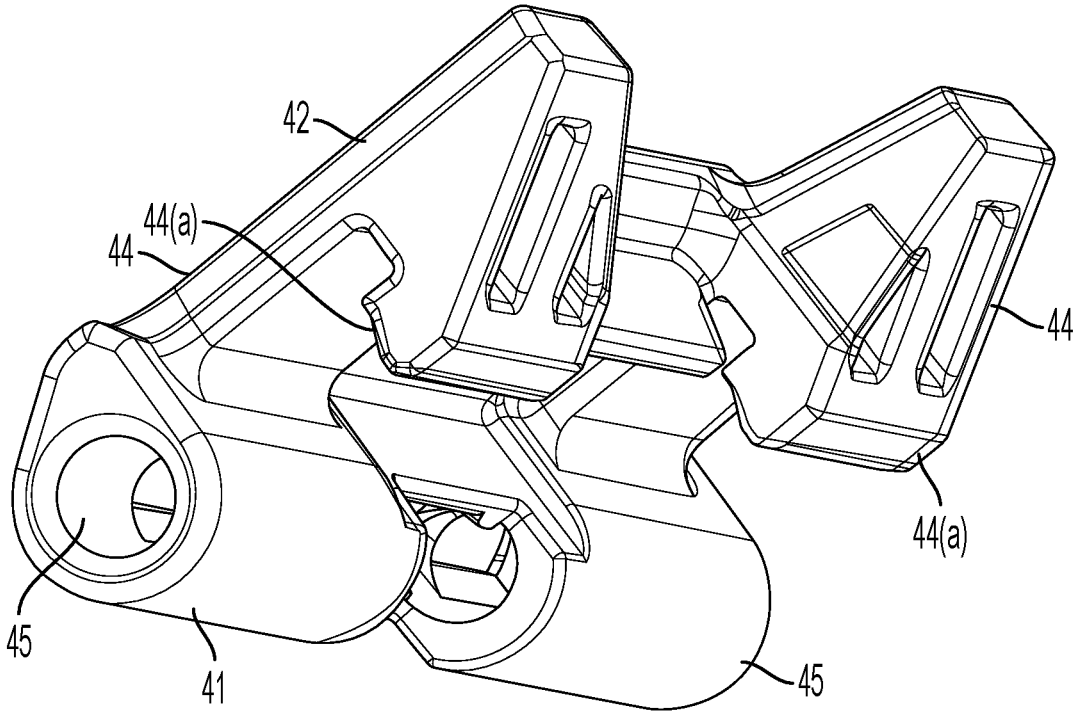
FIG. 10 is a further perspective view of the container latch shown in FIG. 9.

With reference to FIGS. 9-10, container latch 40 is shown. Latch 40 includes cylindrical lower portion 41 having left and right through hole 45 formed therein. Upper portion 42 projects upwardly from cylindrical lower portion 41 and includes overhanging latches 44 projecting inwardly (relative to main lid 20 or secondary lid 24 when disposed thereon) on lateral sides thereof. Each latch 44 includes latch tooth 44(*a*). As noted above one container latch 40 is pivotably disposed in each of main lid cutouts 28 and may be pivoted so that teeth 44(*a*) are disposed above ledge 50(*a*) formed on container 50 shown in FIG. 17 to secure container 50 to the left upper surface of main lid 24. Container latches 40 may also be pivoted outwardly to remove teeth 44(*a*) from ledge 50(*a*) to allow container 50 to be removed.

Figure 12:
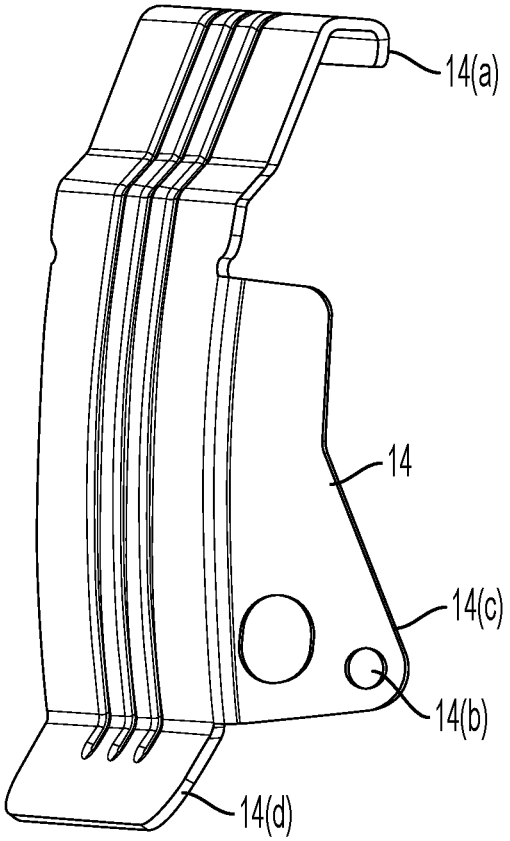
FIG. 12 is a perspective view of a buckle latch forming part of the invention.
Figure 12A:
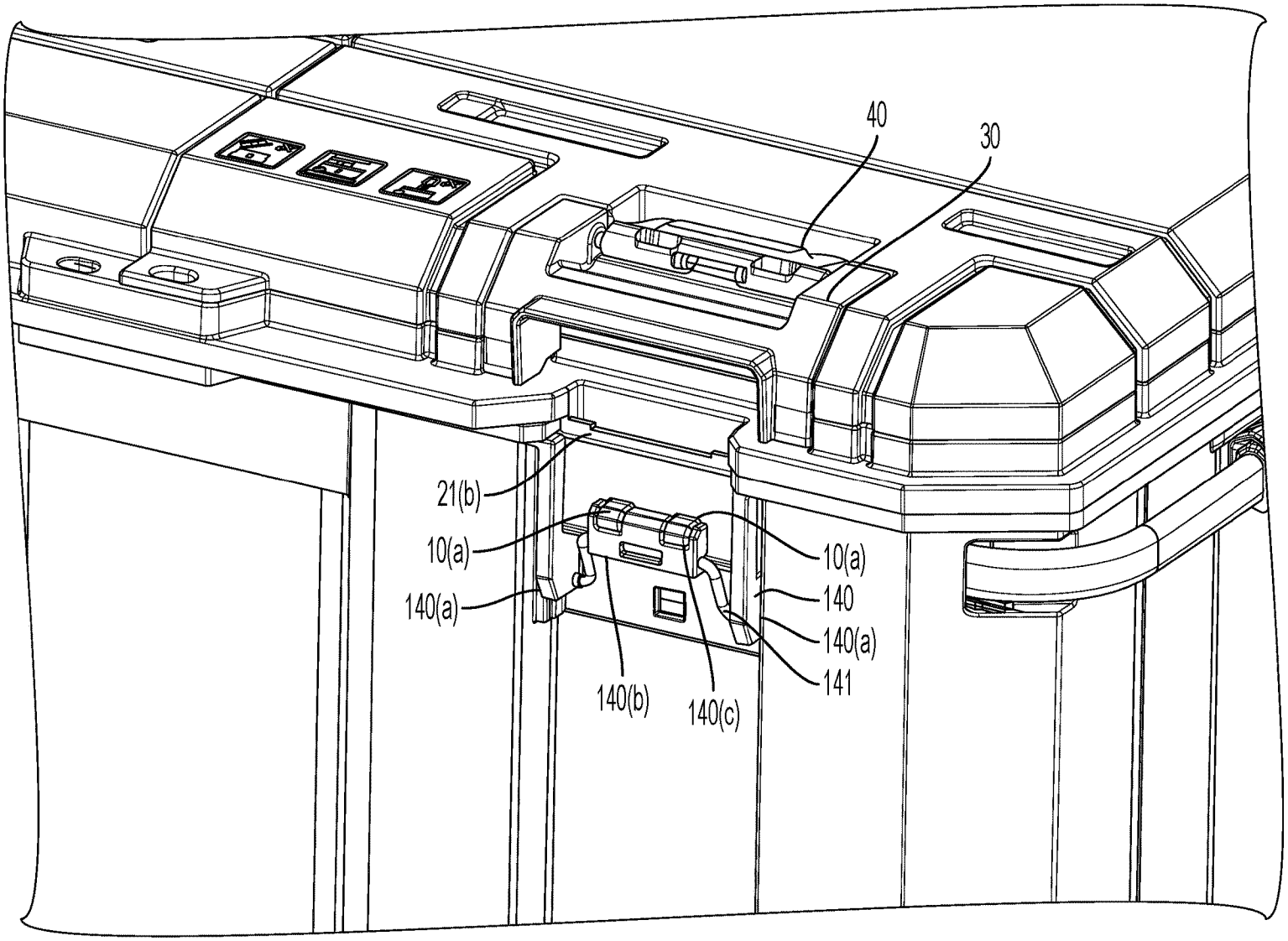
FIG. 12A is a close-up perspective view showing a portion of the chest shown in FIG. 1 with the buckle latch not shown.

With further reference to FIGS. 5, 11 and 12A, a further container latch 40 is pivotably disposed above main body 32 of secondary lid latch 30, between side portions 31 via pivot pins 46 which are disposed through openings holes 45 of container latch 40 and holes 36 of secondary lid latch 30. Container latch 40 may be pivoted between a forward horizontal position where it is substantially parallel to the upper surface of secondary lid 24 and within partial depth cutout 25, to a position in which it extends substantially perpendicular to the upper surface of secondary lid 24 with teeth 44(*a*) extending above the surface, and to an opposite horizontal position in which it is above main body 32 of secondary latch 30. A further container latch 40 is pivotably secured in each full depth cutout 28' formed at the rear of secondary lid 24 via pivot pins. Container 50 may be secured to the upper surface of closed secondary lid 24 with teeth 44(*a*) of container latches 40 disposed in cutouts 28 and 28' secured over ledges 50(*a*). Container latches 40 may be pivoted to an outward position to remove teeth 44(*a*) from ledges 50(*a*) to allow container 50 to be removed from secondary lid 24.

With reference to FIGS. 12 and 12A conventional buckle latch 14 is shown. Buckle latch 14 includes overhanging latch hook 14(*a*) projecting from an upper surface and inwardly extending lateral tabs 14(*c*) on each side. Holes 14(*b*) are formed through each inwardly extending tab 14(*c*). Buckle latch 14 also includes lower tab 14(*d*). Latch adapter 140 includes two vertically extending side portions 140(*a*) with integrally formed rectangular block 140(*b*) extending therebetween. Latch adapter 140 is slidably disposed on storage container 10 via side portions 140(*a*) which are slidably received in channels formed on front side 15 of storage container 10. Metal ring 141 is secured on interior surfaces of vertical side portions 140(*a*) and extends through a channel formed in rectangular block 140(*b*). Rectangular block 140(*b*) includes two indented regions 140(*c*) on the upper surface. Two tabs 10(*a*) extend outwardly from storage body 10. Buckle latch 14 is secured on latch adapter 140 with the lower ends of metal ring 141 disposed through holes 14(*b*) to allow buckle latch 14 to pivot relative to adapter 140 and storage body 10.

In order to secure main lid 20 to storage container 10, right buckle latch 14 and adapter 140 are moved upwardly to allow hook 14(*a*) of right buckle latch 14 to be disposed over and behind main lid ledge 21(*b*). Latch buckle tab 14(*d*) of right buckle latch 14 is then pushed inwardly to secured hook 14(*a*) in contact with and behind right main lid ledge 21(*b*) to secure main lid 20 to storage body 10. Similarly, latch buckle tab 14(*d*) of left buckle latch 14 would be contact with and behind left main led ledge 21(*a*). In this situation secondary lid 24 can still be pivoted upwardly by independent operation of secondary lid latch 30 to separately release secondary lid 24 from main lid 20, while main lid 20 remains secured to storage body 10 by both buckle latches 14. Upward movement of each buckle latch 14 is precluded due to contact of tabs 10(*a*) with latch block 140(*b*) in order to ensure that hook 14(*a*) remains secured behind lid ledge 21(*b*). To release each latch buckle 14, latch lower tabs 14(*d*) may be pulled outwardly to allow blocks 140(*b*) to be removed from contact with tabs 141. Latch buckle 14 can then be raised slightly to allow hooks 14(*a*) to be removed from ledges 21(*a*) and 21(*b*) to thereby allow main lid 20 to pivot upwardly from storage body 10.

Figure 13:
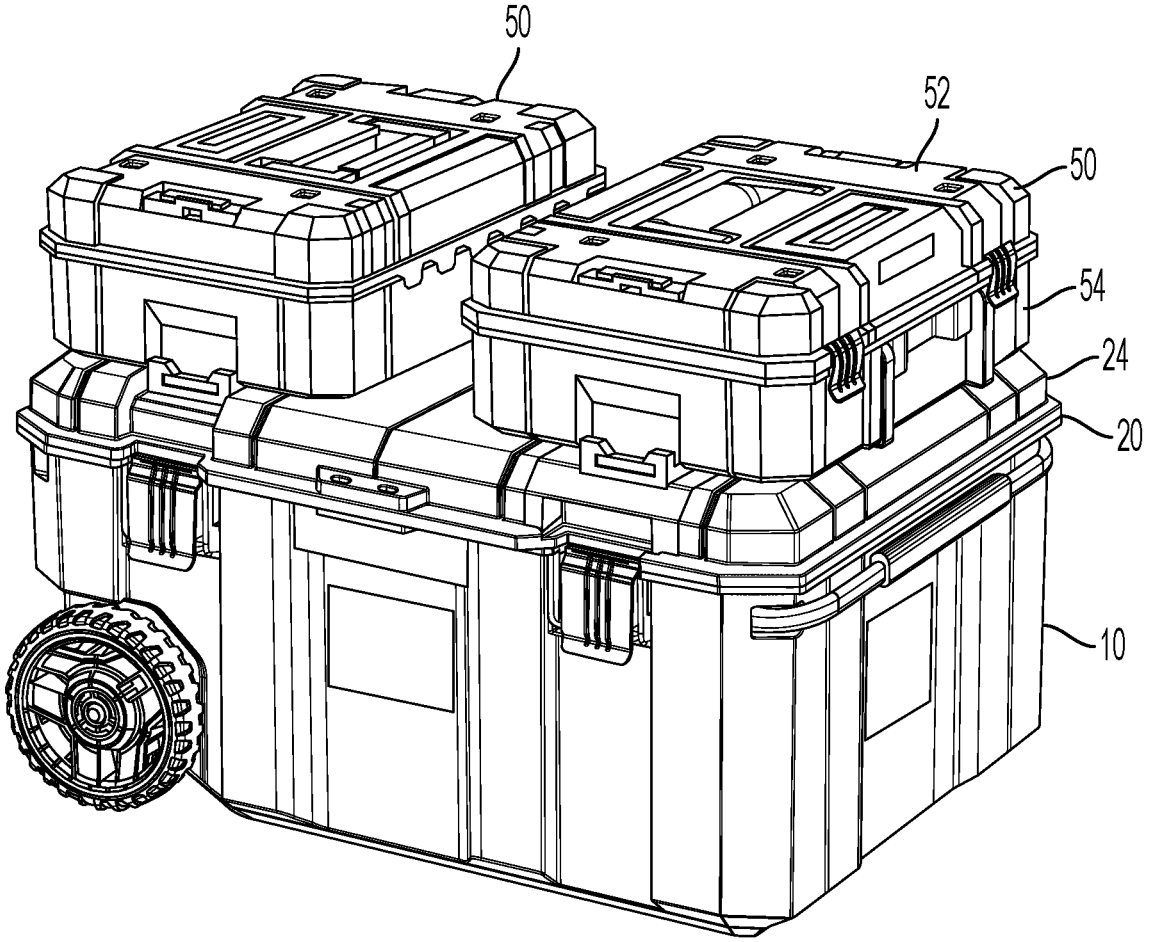
FIG. 13 a perspective of the chest having storage containers stacked and secured thereon according to the invention.
Figure 14:
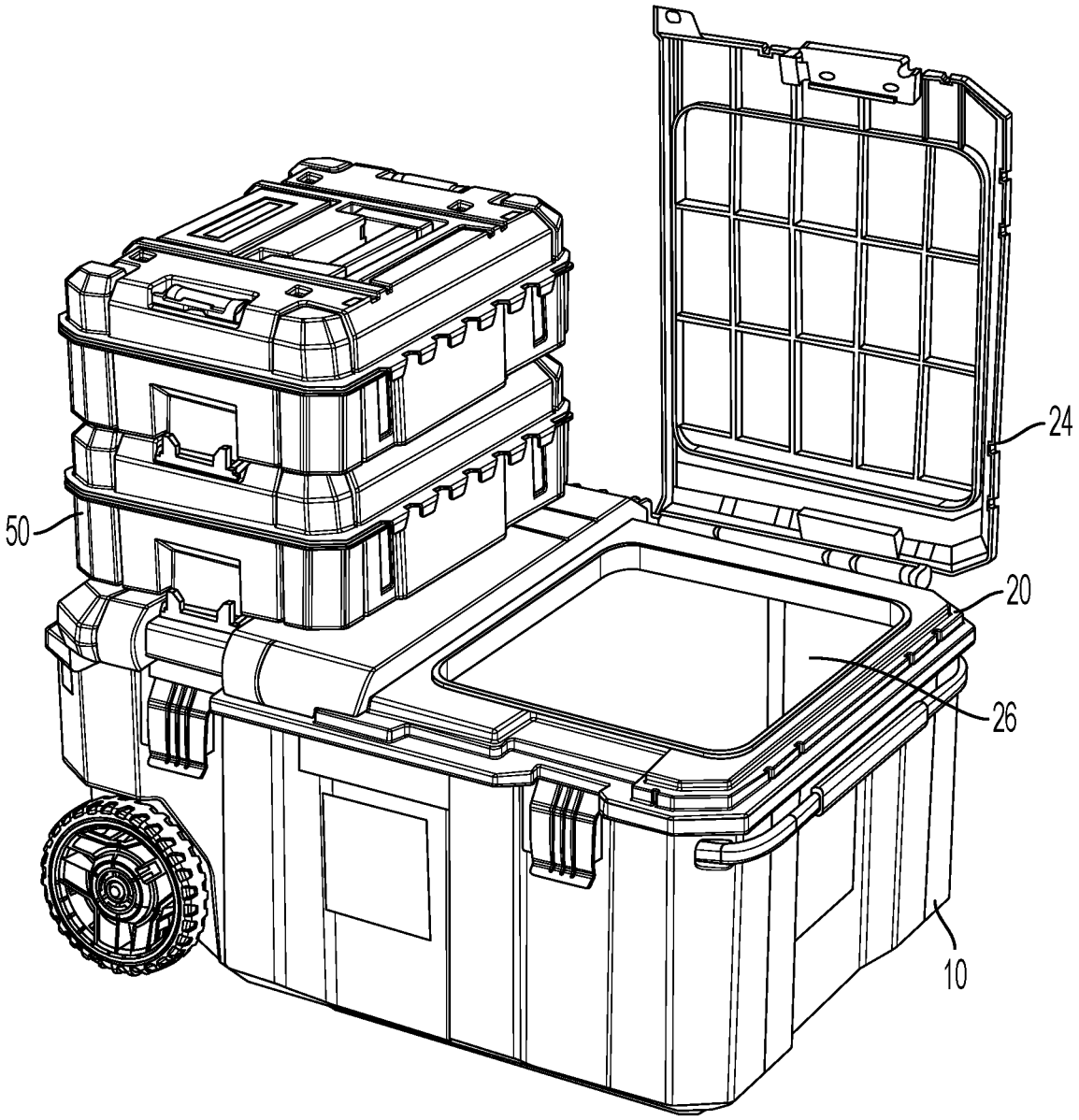
FIG. 14 is a perspective view of the chest having two storage containers stacked and secured on the main lid thereof and showing the secondary lid in the open position.
Figure 16:
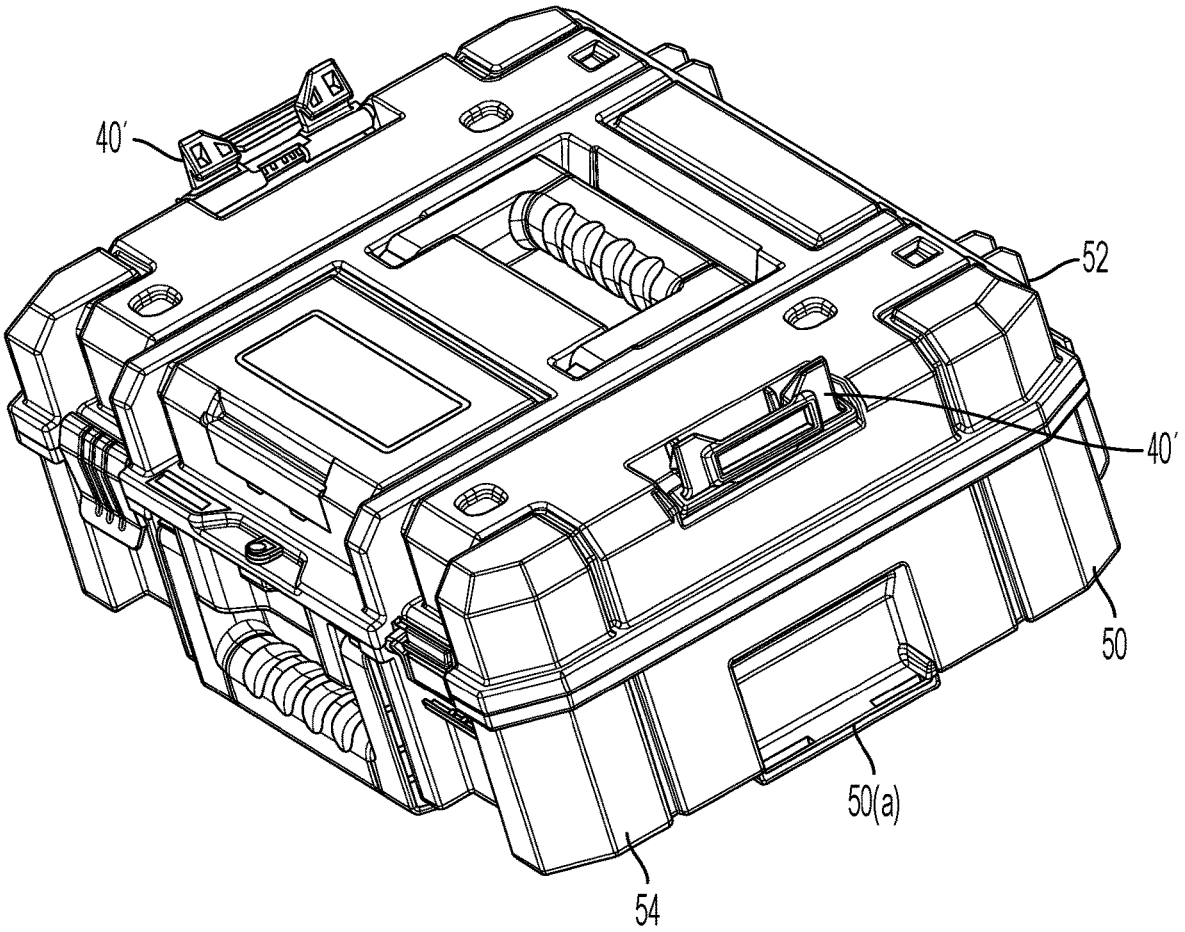
FIG. 16 is a perspective view of a container which can be secured to the chest shown in FIG. 1.

With reference to FIGS. 13, 14 and 16, various modes of operation of the invention are shown. In FIG. 13, two storage containers 50 (as shown in FIG. 16) are shown secured on storage body 10. Containers 50 each include a storage body 54 having a pivotable lid 52 secured thereon. Pivotable lid 50 includes container latches 40' (having the same structure as container latches 40 described above) on both short sides thereof. Storage bodies 54 each have ledges 50(*a*) disposed on the lower ends thereof at a location beneath latches 40'. Left side storage container 50 is secured directly to main lid 20 via front and rear container latches 40 disposed on main lid 20 which are pivoted upwardly such that teeth 44(*a*) are disposed over ledges 50(*a*). Right side container 50 is secured on secondary lid 24 via front and rear container latches 40 which are disposed over ledges 50(*a*). Main lid 20 is secured to storage body 10 via buckle latches 14. In this situation, the combined chest 1 with containers 50 secured thereon can be moved by use of telescoping extending handle 17 and wheels 11. With reference to FIG. 14, further containers 50 can also be stacked and secured on either or both of containers 50 shown in FIG. 13. (Stacked container 50 is shown stacked only on left side container 50 in FIG. 14, but a further container 50 could also be stacked on right side container 50.)

With further reference to FIG. 14, with right side container 50 removed, secondary lid 24 can be pivoted upwardly to allow access to interior storage volume 16, without opening main lid 20 or moving either of the left side containers 50 which remain securely attached to the left side of main lid 20.

Figure 15A:
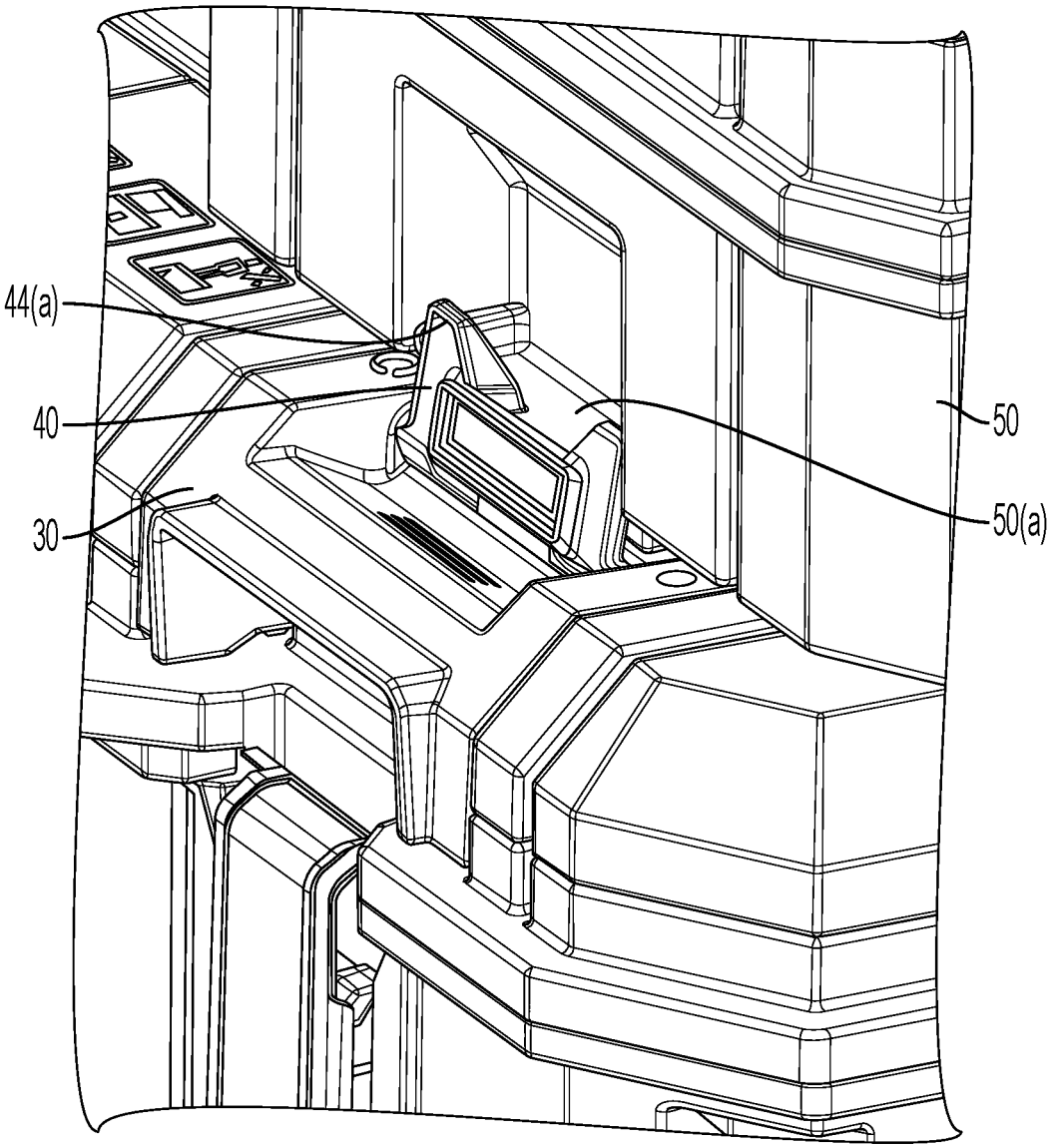
FIG. 15A is a perspective close-up view showing the secondary lid having a container stacked thereon.
Figure 15B:
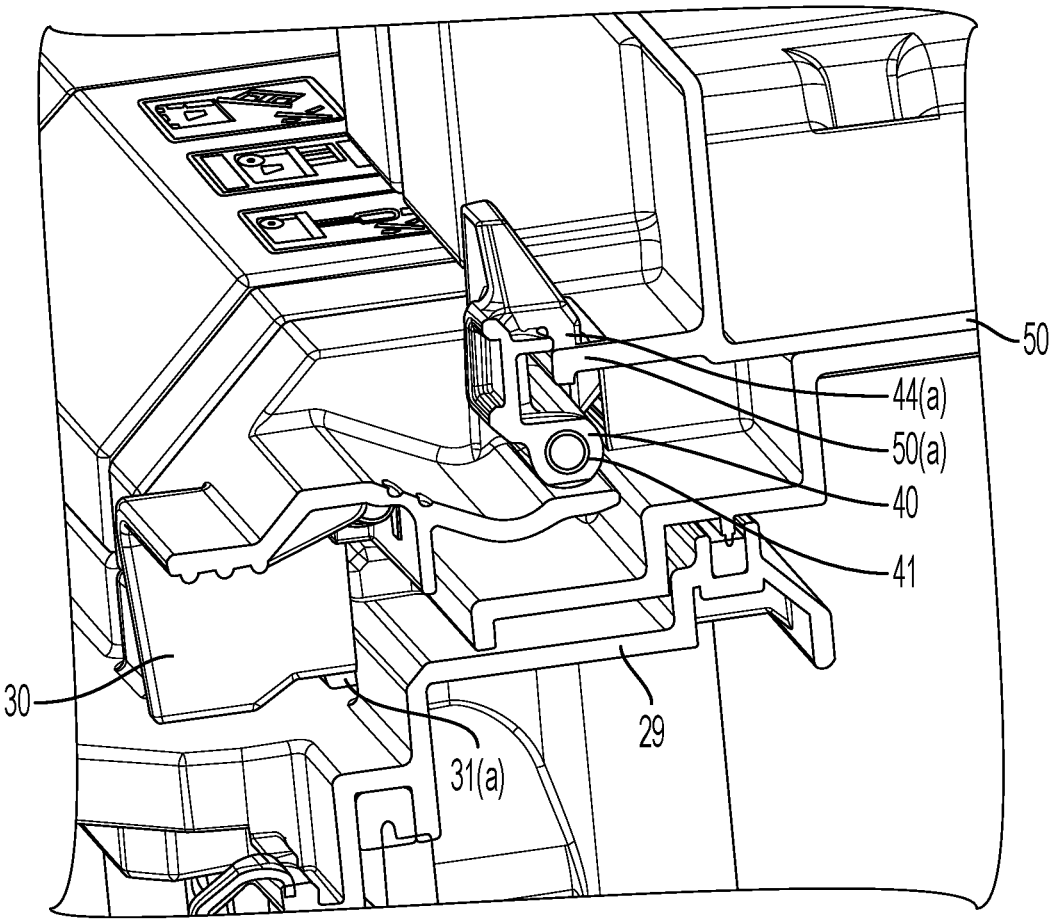
FIG. 15B is a perspective cross sectional view showing the second lid having a container stacked thereon with the container latch in a first position.
Figure 15C:
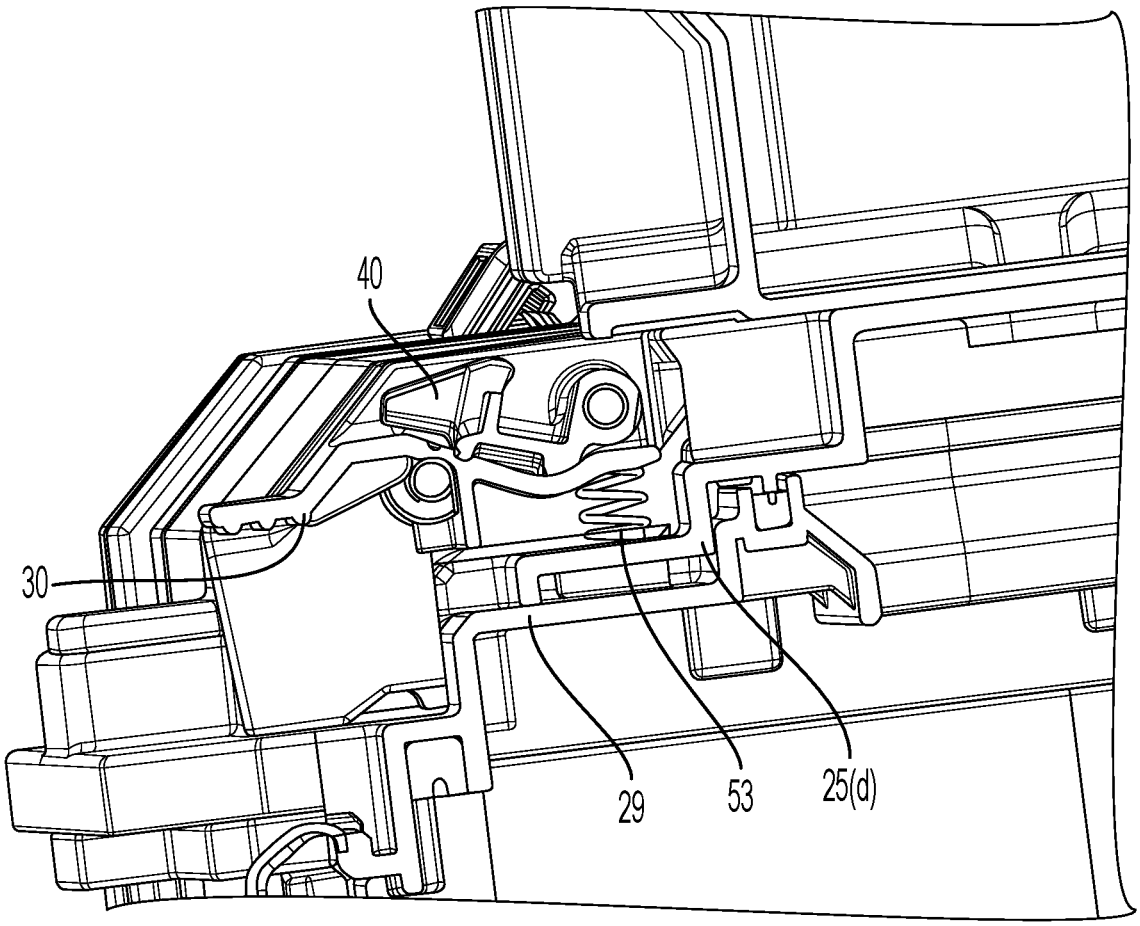
FIG. 15C is a perspective cross sectional view showing the secondary lid having a container stacked thereon with the container latch in a second position.

As shown in FIG. 15A, right side container 50 is secured on secondary lid secondary lid 24 via container latch 40 which is pivoted into its upper position with teeth 44(*a*) disposed over container ledge 50(*a*). In this condition, as shown in FIG. 15B, since upper portion 42 and latches 44 are in physical contact with ledge 50(*a*), and since container latch 40 is physically connected to secondary lid latch 30 via pivot pins 46, pivoting rotation of secondary lid latch 30 is precluded due to the interference of container latch 40 and ledge 50(*a*). That is, any attempt to pivot the outer portion of secondary lid latch 30 upwardly is precluded since the resultant downward motion of the inner portion of secondary lid latch 30 and container latch 40 connected thereto would be precluded by container latch 40's firm contact with ledge 50(*a*). Therefore, secondary lid latch lower teeth 31(*a*) cannot be moved outwardly from underneath secondary lid locking ledge 29, such that secondary lid 24 remains secured to main lid 20 and cannot be pivoted to the open state.

Figure 15D:
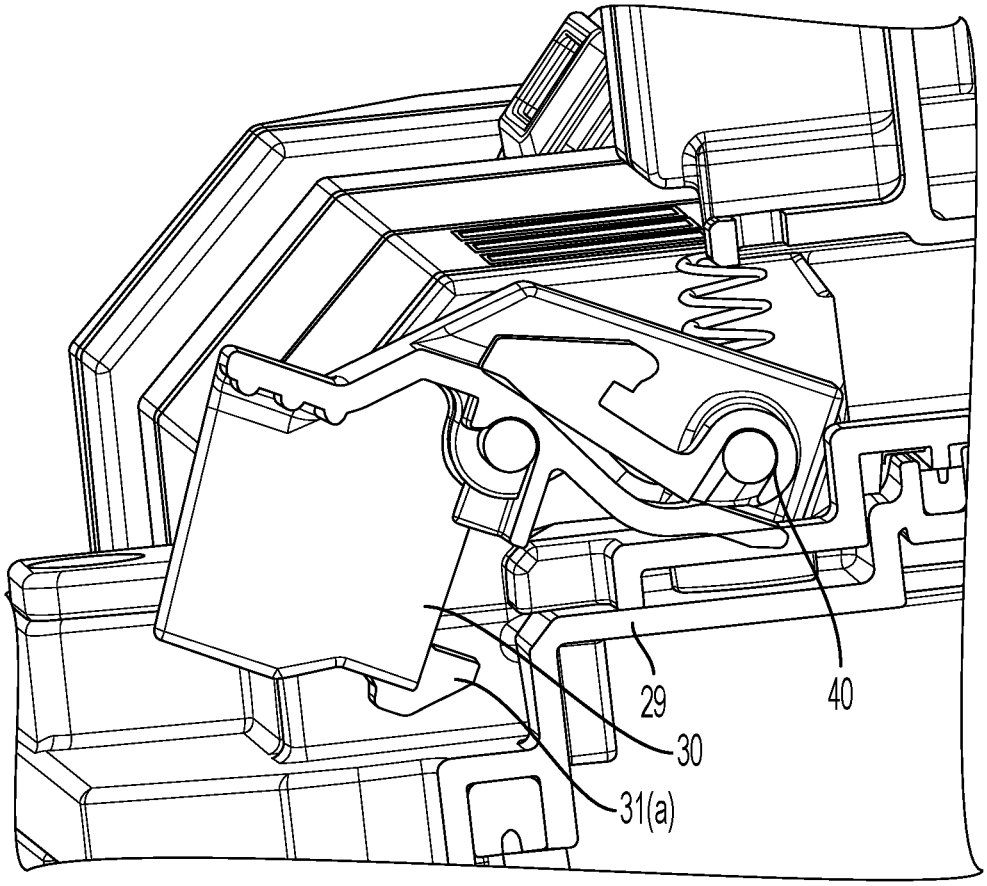
FIG. 15D is a perspective cross sectional view showing the secondary lid having a container stacked thereon with the container latch in a second position and the secondary lid latch rotated.

With reference to FIG. 15C, container latch 40 has been pivoted outwardly of container 50, with teeth 44(*a*) having been removed from behind ledge 50(*a*). Container latch 40 now rests against the upper surface 32 of secondary lid latch 30. In this situation, since container latch 40 is no longer in contact with ledge 50(*a*), the combined secondary lid latch 30 and container latch 40 may be pivoted upwardly (clockwise in the figure) about pivot pins 35 to the position shown in FIG. 15D. Secondary lid latch upper teeth 38 move into openings 25(*a*), while secondary lid latch lower teeth 31(*a*) move outwardly of secondary lid locking ledge 29. Therefore, secondary lid 24 may freely pivot to the open state.

While the invention has been described by way of exemplary embodiments, it is understood that the words which have been used herein are words of description, rather than words of limitation. Changes may be made within the purview of the appended claims, without departing from the scope and spirit of the invention in its broader aspects.

The invention claimed is:

1. A chest having:

a storage body defining an interior storage volume;

a main lid pivotable between a first main lid position in which said main lid covers the interior storage volume and a second main lid position in which said main lid does not cover the interior storage volume, the main lid having a main lid opening formed therethrough and a main lid ledge;

a secondary lid pivotable between a first secondary lid position in which said secondary lid covers said main lid opening and a second secondary lid position in which said secondary lid does not cover said main lid opening to allow access to said interior storage volume while said main lid is in said first main lid position;

a secondary lid latch secured to said secondary lid, said secondary lid latch movable between a first secondary lid latch position in which said secondary lid latch secures said secondary lid to said main lid and a second secondary lid latch position in which said secondary lid latch does not secure said secondary lid to said main lid;

a container latch secured to said secondary lid latch, said container latch movable between a first container latch position in which said secondary latch is precluded from moving between the first secondary lid latch position and the second secondary latch position and a second container latch position in which said secondary latch is not precluded from moving between the first secondary lid latch position and the second secondary latch position.

2. The chest recited in claim 1, said secondary lid including a secondary lid cutout region, said secondary lid latch pivotably secured in said secondary lid cutout region.

3. The chest recited in claim 2, said secondary lid latch including a main body and a first and a second secondary lid upper projecting arm extending on either side of said main body, said container latch pivotably secured on either side thereof in said projecting arms and extending above said main body.

4. The chest recited in claim 3, wherein, when said container latch is in the first container latch position it extends upwardly from said secondary lid main body and when said container latch is in the second container position it extends substantially horizontally over said main body.

5. The chest recited in claim 4, said container latch including an inwardly extending tooth, said tooth disposable above a step formed in a container to thereby secure said container to said secondary lid.

6. The chest recited in claim 5, said storage body including a latch buckle disposed thereon, said latch buckle removably disposable over said main lid ledge to secure said main lid to said storage body.

7. The chest recited in claim 1, said storage body including a latch buckle disposed thereon, said latch buckle removably disposable over said main lid ledge to secure said main lid to said storage body.

8. The chest recited in claim 1, said secondary lid latch including a main body and a second secondary lid latch arm extending on at least one side of said main body, said secondary lid latch arm including an inwardly extending tooth, said secondary lid including a secondary lid cutout region and a ledge disposed over said secondary lid cutout region, wherein when said secondary lid latch is in the first secondary lid latch position said tooth is disposed below said ledge and said secondary lid latch may be moved to said second position in which said tooth is not disposed below said ledge.

9. A chest comprising:

a storage body defining an interior storage volume;

a main lid having a main lid opening formed therethrough;

a secondary lid disposed on said main lid and movable between a first secondary lid position where said secondary lid covers said main lid opening and a second secondary lid position where said secondary lid does not cover said main lid opening;

a first latch disposed on said secondary lid, said first latch configured to releasably secure an external container to said secondary lid; and a second latch movable between a first latch position in which said second latch secures said secondary lid in the first secondary lid position and a second latch position in which said second latch does not secure said secondary lid in the first secondary lid position, wherein the first latch is pivotably secured on the second latch.

10. The chest recited in claim 9, wherein, when the external container is secured to said secondary lid, said second latch cannot move between the first secondary latch position and the second secondary latch position.

11. The chest recited in claim 10, wherein said first latch includes a tooth and said container having a step, wherein said tooth is disposed above said step to secure the external container to said secondary lid in the first latch position, and when said tooth is disposed above said step said secondary latch is precluded from moving to said second latch position.

12. The chest recited in claim 10, said main lid movable between a first main lid position in which said main lid covers at least a portion of said interior storage volume and a second main lid position in which said main lid does not cover said interior storage volume, said chest further comprising a buckle latch releasably securing main lid in said first main lid position.

13. The chest recited in claim 9, said main lid movable between a first main lid position in which said main lid covers at least a portion of said interior storage volume and a second main lid position in which said main lid does not cover said interior storage volume, said chest further comprising a buckle latch releasably securing main lid in said first main lid position.

14. A stackable system including a chest and a container: said container comprising a step; and said chest comprising:

a storage body defining an interior storage volume;

a main lid pivotable between a first main lid position in which said main lid covers at least a portion of the interior storage volume and a second main lid position in which said main lid does not cover the interior storage volume, the main lid having a main lid opening formed therethrough and a main lid ledge;

a secondary lid pivotable between a first secondary lid position in which said secondary lid covers said main lid opening and a second secondary lid position in which said secondary lid does not cover said main lid opening to allow access to said interior storage volume via said main lid opening while said main lid is in said first main lid position;

a secondary lid latch secured to said secondary lid, said secondary lid latch movable between a first secondary lid latch position in which said secondary lid latch secures said secondary lid to said main lid and a second secondary lid latch position in which said secondary lid latch does not secure said secondary lid to said main lid;

a container latch secured to said secondary lid, said container latch including a latch tooth, said container latch movable between a first container latch position in which said latch tooth may overlie said step to secure said container to said secondary lid when said container is disposed on said secondary lid and a second position in which said latch tooth does not overlie said step to allow said container to be removed from said secondary lid;

wherein, when said container latch is in the first container latch position with said container disposed on said secondary lid, said secondary lid latch is precluded from moving between the first secondary lid latch position and the second secondary lid latch position.

15. The stackable system recited in claim 14, said chest further comprising a buckle latch releasably securing said main lid in said first main lid position.

16. The stackable system recited in claim 14, said secondary lid including a secondary lid cutout region, said secondary lid latch pivotably secured in said secondary lid cutout region.

17. The stackable system recited in claim 16, said secondary lid latch including a main body portion and a first and a second secondary lid upper projecting arm extending on either side of said main body portion, said container latch pivotably secured on either side thereof in said projecting arms and extending above said main body portion.

18. The stackable system recited in claim 17, wherein, when said container latch is in the first container latch position it extends upwardly from said secondary lid main body portion and when said container latch is in the second container latch position it extends substantially horizontally over said main body portion.

19. The stackable system recited in claim 17, said container latch including an inwardly extending tooth, said tooth disposable above said step to thereby secure said container to said secondary lid.

* * * * *